US010918163B1

(12) United States Patent
Blondeau

(10) Patent No.: US 10,918,163 B1
(45) Date of Patent: Feb. 16, 2021

(54) ONE PIECE FOOTWEAR

(71) Applicant: Daniel R. Blondeau, Kowloon (HK)

(72) Inventor: Daniel R. Blondeau, Kowloon (HK)

( * ) Notice: Subject to any disclaimer, the term of this patent is extended or adjusted under 35 U.S.C. 154(b) by 0 days.

(21) Appl. No.: 16/858,606

(22) Filed: Apr. 25, 2020

(51) Int. Cl.
*A43B 23/04* (2006.01)
*A43B 3/12* (2006.01)
*A43B 23/02* (2006.01)

(52) U.S. Cl.
CPC ..... *A43B 23/042* (2013.01); *A43B 3/126* (2013.01); *A43B 23/0245* (2013.01)

(58) Field of Classification Search
CPC ..... A43B 23/042
USPC ..... 36/47–49, 9 R, 9 A
See application file for complete search history.

(56) References Cited

U.S. PATENT DOCUMENTS 1,104,357 A 7/1914 Hassen
1,201,927 A 10/1916 Blum
2,169,337 A * 8/1939 Davis ..... A43B 3/124 36/11.5
2,254,184 A * 8/1941 Mayer ..... A43B 3/124 36/11.5
2,384,927 A * 9/1945 Julianelli ..... A43B 23/025 36/11
2,457,630 A 12/1948 Beetson
2,611,977 A * 9/1952 Masanori ..... A43B 3/106 36/11.5
2,658,510 A * 11/1953 Hilton ..... A61F 13/064 602/58
2,679,117 A 5/1954 Reed
2,682,713 A 7/1954 Eiger
2,974,427 A 3/1961 Wolff
3,057,085 A * 10/1962 Rigsby ..... A43B 3/30 36/97
3,568,338 A 3/1971 Nadler
4,030,212 A 6/1977 Ito
4,194,308 A 3/1980 Karlsson
4,476,600 A 10/1984 Seidal et al.
4,592,152 A * 6/1986 Wright ..... A43B 3/124 36/11.5
5,604,997 A 2/1997 Dieter
8,434,245 B2 5/2013 Bell et al.
9,743,710 B2 * 8/2017 Madelaine ..... A43B 23/042
10,383,401 B2 8/2019 Kilgore
(Continued)

FOREIGN PATENT DOCUMENTS

DE 8132143 1/1982
WO WO2012/140567 10/2012
WO WO2014/194395 12/2014

*Primary Examiner* — Ted Kavanaugh

(57) ABSTRACT

A blank of flexible sheet material used to form and article of footwear upper and an article of footwear having a sole attached to the upper. According to one embodiment the blank of flexible sheet material includes a main bottom portion having a front toe area, a rear heel area and opposed sides, said main bottom portion being in the general shape of a foot sole. A front strap portion having an elongated shape extends outward from one of the opposed sides of the main bottom portion near the front toe area and having a free end, and a pair of heel-strap flaps extend outward from opposite sides of the main bottom portion near the rear heel area and configured to form an enclosed heel portion and a rear strap of the shoe upper. According to another embodiment the front strap is formed separately from the main bottom portion and pair of heel-strap flaps.

9 Claims, 5 Drawing Sheets

(56) References Cited

U.S. PATENT DOCUMENTS

| | | | |
|---|---|---|---|
| 2007/0199210 | A1 | 8/2007 | Vattes et al. |
| 2018/0343956 | A1 | 12/2018 | Li et al. |

* cited by examiner

ONE PIECE FOOTWEAR

BACKGROUND

The present invention relates generally to an article of footwear that is fabricated from either a one-piece blank of material or a combination of a blank of material and a separate toe strap, and a method of fabricating articles of footwear.

Typically, many types of footwear are made by what is known as a cut and sew method, in which individual pieces of material are cut out and sewn together to form the three-dimensional ("3-D") shape of a footwear upper. In such a process, individual pieces of material are cut out according to a pattern, in which individual pieces are designated to form specified portions of the shoe upper. When the pieces are cut out, they are typically marked according to the portion of the upper which they are intended to form. The individual pieces are bonded, stitched and then lasted, giving the shoe the necessary 3-D shape. Other portions of the shoe may then be attached to the upper, such as an outsole, midsole, footbed, etc.

The cut and sew method requires a large number of steps, each requiring a skilled person for completion thereof. The necessary steps of sorting out the individual pieces, aligning each piece, and bonding/stitching the pieces in their correct location can get more and more complicated, depending on the complexity of the footwear and number of pieces that must be assembled.

There are a limited number of shoe constructions in which the shoe upper or the entire shoe itself is made from a blank of material by folding and stitching the blank in a particular way. For example, one type of shoe upper or shoe-like construction involves the use of a single, generally symmetrical blank wherein the bottom of the shoe upper or shoe construction is situated in the general center of the blank. The toe, side and heel portions of the shoe structure are positioned generally around the bottom portion. The toe portion is located on the opposite side of the bottom portion than the heel portion, and one side portion is located on the opposite side of the bottom portion than the other side portion. The shoe structure is created by generally folding the side portions, heel portion and toe portion upward and stitching them appropriately such that a shoe-like or shoe upper construction is formed. The shoe upper formed can then be attached to a shoe sole.

U.S. Pat. No. 1,104,357 to Hassel and U.S. Pat. No. 2,974,427 to Wolff disclose slipper-style shoes that are constructed from blanks of material.

U.S. Pat. No. 4,194,308 to Karlsson discloses a shoe constructed from a blank of material that is formed such that generally one half of the shoe construction is formed on one side of the blank and the other half of the shoe construction is formed on the other side of the blank. The shoe construction is formed by generally folding the blank upon itself and stitching the bottom and toe portion edges together to form a foot enclosure.

Other examples of footwear are found in U.S. Pat. No. 1,201,927 to Blum, U.S. Pat. No. 2,279,117 to Reed, U.S. Pat. No. 2,682,713 to Eiger, U.S. Pat. No. 3,568,338 to Nadler, U.S. Pat. No. 5,604,007 to Dieter, U.S. Pat. No. 8,434,245 to Bell et al. and U.S. Pat. No. 10,383,401 to Kilgore, and U.S. Patent Application Publication Nos. 2007/0199210 to Vattes et al. and 2018/0343956 to Li et al., and International Patent Publication Nos. WO2012/140567 to Levorato and WO2014/194395 to Fortes, and German Application Publication No. DE8132143 to Kpitz.

The present invention provides an article of footwear and a method of making the same from either a one-piece blank of material or a combination of a blank of material and a separate toe strap that provides for simplified fabrication

BRIEF SUMMARY

According to various features, characteristics and embodiments of the present invention which will become apparent as the description thereof proceeds, the present invention provides a pattern for cutting flexible sheet material for forming an article of footwear upper, said pattern comprising:

a main bottom portion having a front toe area, a rear heel area and opposed sides, said main bottom portion being in the general shape of a foot sole;

a front strap portion having an elongated shape; and and a pair of heel-strap flaps extending outward from opposite sides of the main bottom portion near the rear heel area and configured to form an enclosed heel portion and a rear strap of the shoe upper, wherein the main body portion and the pair of heel-strap flaps comprise a single piece of flexible sheet material.

The present invention further provides a method of manufacturing an article of footwear upper which comprises:

obtaining a pattern of flexible sheet material for forming an article of footwear upper, said pattern comprising:

a main bottom portion having a front toe area, a rear heel area and opposed sides, said main bottom portion being in the general shape of a foot sole; and and a pair of heel-strap flaps extending outward from opposite sides of the main bottom portion near the rear heel area and configured to form an enclosed heel portion and a rear strap of the shoe upper, attaching the pair of heel-strap flaps together to form an enclosed heel portion and a rear ankle strap, and attaching a front strap across the front toe area to from a toe strap.

The present invention further provides an article of footwear upper and an article of footwear made from the pattern of flexible sheet material and made by the method of manufacturing an article of footwear upper

BRIEF DESCRIPTION OF THE DRAWINGS

The present invention will be described with reference to the attached drawings which are given as non-limiting examples only, in which.

DETAILED DESCRIPTION OF THE DRAWINGS AND THE PRESENTLY PREFERRED EMBODIMENTS

Figure 1:
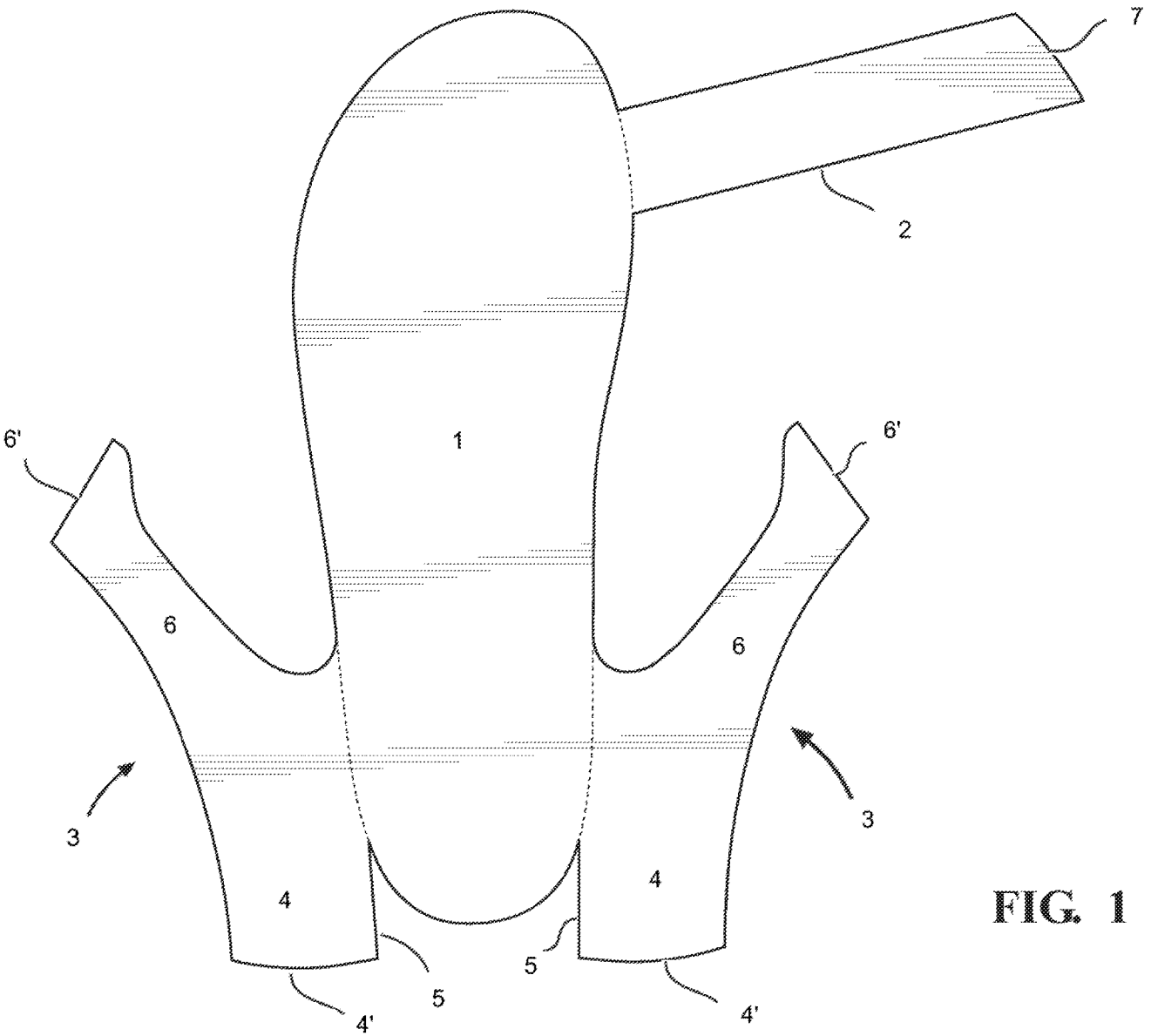
FIG. 1 is plan view of a blank of material used according to one embodiment of the present invention to fabricate a shoe upper.

The present invention provides an article of footwear and a method of making the same from a one-piece blank of material or the combination of a blank of material and a separate toe strap that provides for simplified fabrication. The article of footwear includes a bottom portion that includes a rear heel area and a front toe area. A rear strap extends forward from the heel to wrap around the ankle of a wearer. A front strap extends across the toe area from opposite sides of the bottom portion. It is noted that in the present description the terms "rear strap" and "ankle strap" and "front strap" and "toe strap" are synonymous unless the context indicates otherwise.

According to one embodiment of the present invention, the bottom portion, including the rear heel area and front toe area, and the rear and front straps are all formed from a one-piece blank of material from which the upper is made. In another embodiment of the present invention the bottom portion, including the rear heel area and the front toe area, and the rear strap are formed from a single blank of material and the front strap is formed from a separate piece of material.

As described below, in the one-piece embodiment of the present invention, the blank of material includes a main bottom portion, a front strap portion that extends outward at an obtuse angle from the main bottom portion, and a pair of heel-strap flaps.

The upper is formed by attaching the rear portions of the pair of heel-strap flaps to one another and to the rear end of the main bottom portion, thereby forming the enclosed heel of the upper. The free ends of the strap portions of the heel-strap flaps are attached to one another to form the rear or ankle strap of the upper and the free end of the front strap portion is attached to the opposite side of the main bottom portion to form the front or toe strap. In one embodiment of the one-piece configuration, that is discussed below, an intermediate portion of the front strap portion can also be attached to the bottom so as to form separate loops for a wearer's large toe and the wearer's remaining toes.

Once the upper is formed the upper can be attached to a sole made from a suitable material such as ethyl vinyl acetate. The attachment of the upper to the sole can be by stitching and/or gluing and/or bonding.

The material from which the upper is made (that is the material from which the blank of material and toe strap are formed) can be elastically stretchable so as to allow a wearer of the footwear to slide his or her foot through the rear or ankle strap while allowing the rear or ankle strap to retract snuggly against the anterior of wearer's ankle. In a similar manner the front or toe strap can fit snuggly over the wearer's toes after the wearer's toes are inserted beneath the front or toe strap, if desired. According to one embodiment the upper made from the blank of material can be made from neoprene or neoprene/polyester face fabric.

Other flexible materials from which the upper and blank of material (and toe strap) can be made of include silicon, neoprene, natural rubber foams, synthetic rubber foams and polyurethane, polyether and polyester foams neoprene, vinyl nitrile, styrene-butadiene rubber (SBR), polyethylene (PE), ethyl vinyl acetate (EVA), ethylene propylene terpolymer (EPT), EPT/PE/butyl rubber, neoprene/EPT/SBR, epichlorohydrin (ECH), and nitrile (NBR) or a combination thereof. In addition, suede, other soft flexible leathers and other synthetic materials can be used.

The articles of footwear provided by the present invention are a type of sandal in that they provide a sole that is attached to a person's foot by means of the rear and front straps. They are ideal to wear at beaches, around pools, public showers, boating or anywhere casual sandal type footwear is worn.

FIG. 1 is plan view of a blank of material used according to one embodiment of the present invention to fabricate a shoe upper. The blank or pattern of material can be cut and/or stamped from neoprene or a neoprene fabric or one of the other materials discussed herein.

As shown the blank or pattern from which the article of footwear is made includes a main bottom portion 1 that corresponds to the bottom of the upper, a front strap portion 2 that extends outward at an obtuse angle from the main bottom portion 1, and a pair of heel-strap flaps 3 at the rear side areas of the main bottom portion 1.

As can be understood, the main bottom portion 1 of the blank or pattern is generally shaped like the sole of a person's foot and can have the overall shape of either a person's left or right foot. In FIG. 1 the main bottom portion 1 has the general shape of a person's left foot. In use, the article of footwear of the present invention would be provided as a pair of sandals, including left and right pair members.

The pair of heal-strap flaps 3 are used to form an enclosed heel portion 13 (See FIG. 4) of the article of footwear into which a wearer can insert the heel of his or her foot. As shown, the heal-strap flaps 3 include rear portions 4 that are substantially parallel to one another and to the centerline of the main bottom portion 1. The enclosed heel portion 13 is formed by attaching the free rear ends 4' of the rear portions 4 of the pair of heel-strap flaps 3 together to one another, and attaching rear inner edges 5 of the rear portions 4 of the heel-strap flaps 3 to the rear edge of the main bottom portion 1. This attachment or attaching can be performed by stitching and/or gluing and/or heat fusing or bonding (depending on the material of fabrication), and any other known method used in the art of fabricating footwear.

The heel-strap flaps 3 also include outward curving forward portions 6 having free front edges 6'. The rear or ankle strap 9 is formed by attaching the free front edges 6 of the outward curving forward portions 6 of heel-strap flaps 3 to one another (See FIG. 5).

Figure 4:
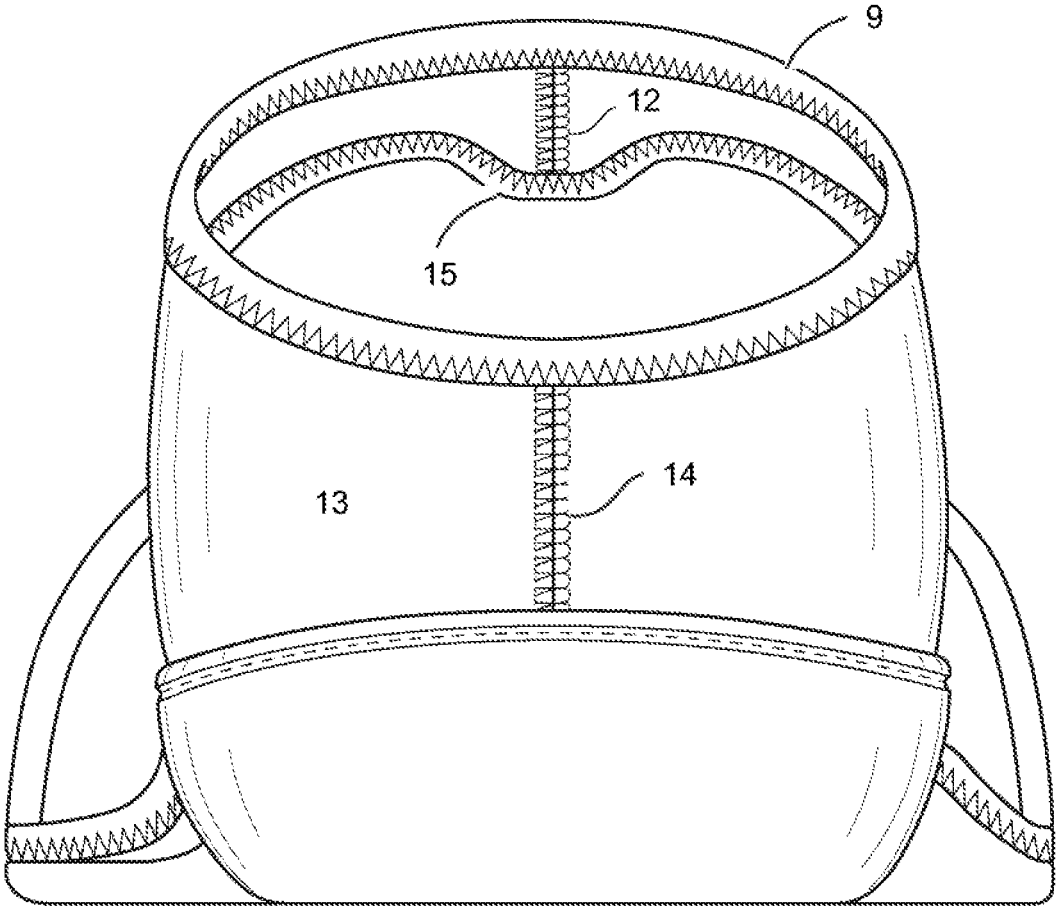
FIG. 4 is a rear view of the article of footwear of FIG. 2.
Figure 5:
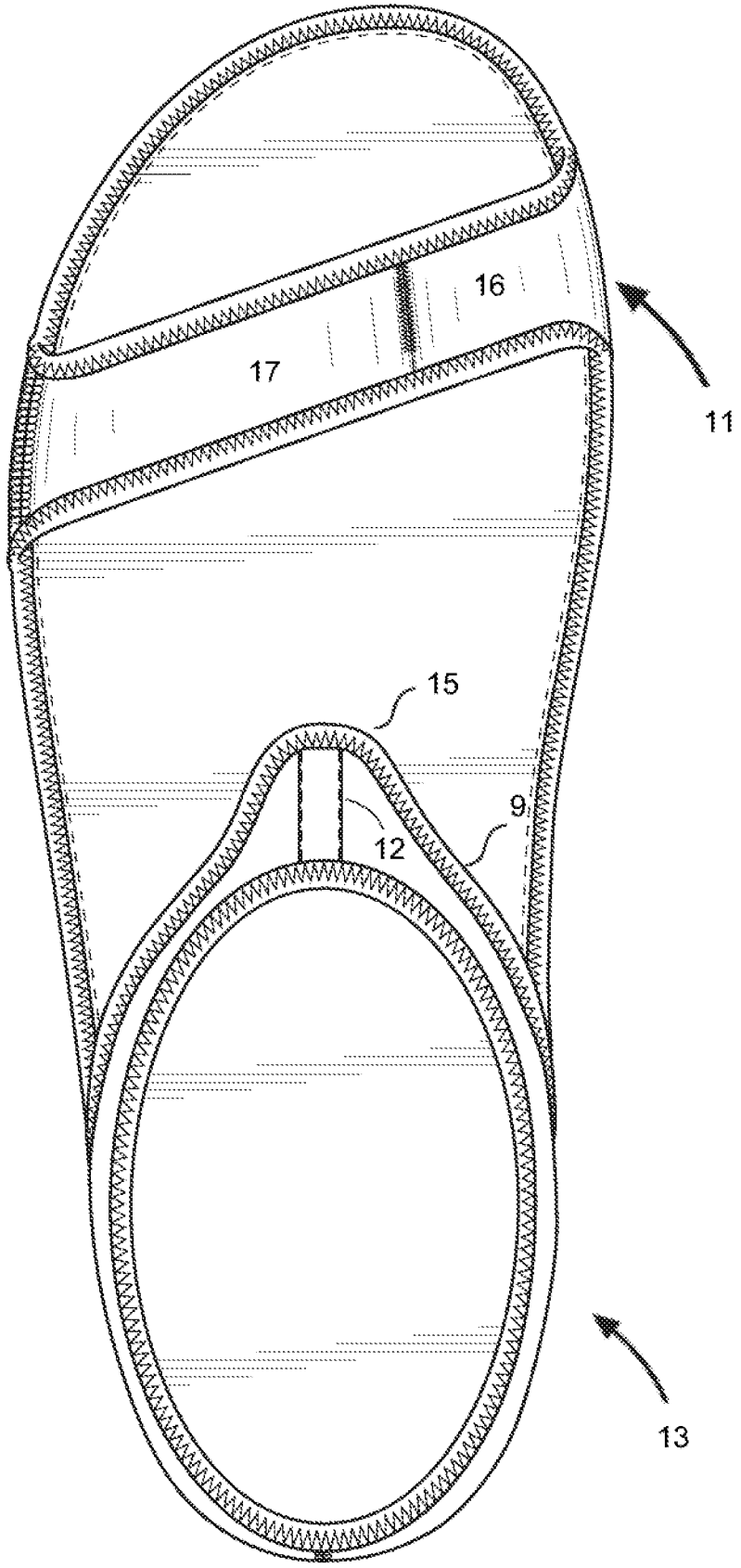
FIG. 5 is a top view of the article of footwear of FIG. 2.

To form the front or toe strap 11, the free end 7 of the front strap portion 2 is attached to a portion of the edge along the opposite side of the main bottom portion 1 (See FIG. 5). In the embodiment shown in FIGS. 1-5, the front or toe strap 11 is configured and aligned to extend across a wearer's toes at an angle that is similar to the angle along the ends of a wearer's toes. As can be understood, this configuration determines the oblique angle at which the front strap portion 2 extends from the main portion 1 of the blank or pattern.

As noted above, in addition to the free end 7 of the front strap portion 2 being attached to a portion of the edge along the opposite side of the main portion 1, one or more intermediate areas of the front strap portion 2 can be attached to the main portion 1 so as to form separate toe loops, including for example a separate toe loop for a wearer's big toe, the remaining toe being together under a remaining portion of the front or toe strap 11.

In other embodiments that are not illustrated, the front or toe strap 11 could be configured to extend across the main portion 1 (or a wearer's toes) at other angles.

The front strap portion 2 is shown as having a uniform width. In other embodiments, the width of the front strap portion 2 can very as desired. Further in some embodiments the front strap portion 2 could be configured to cover all or a portion of the entire toe area of resulting article of footwear.

The rear or ankle strap 9 is shown as having a center portion 15 that protrudes toward the toe area (See FIGS. 2-5). This forward protruding center portion 15 serves as a tab that a wearer of the article of footwear can grasp and pull when sliding his or her foot though the rear or ankle strap 9.

Figure 2:
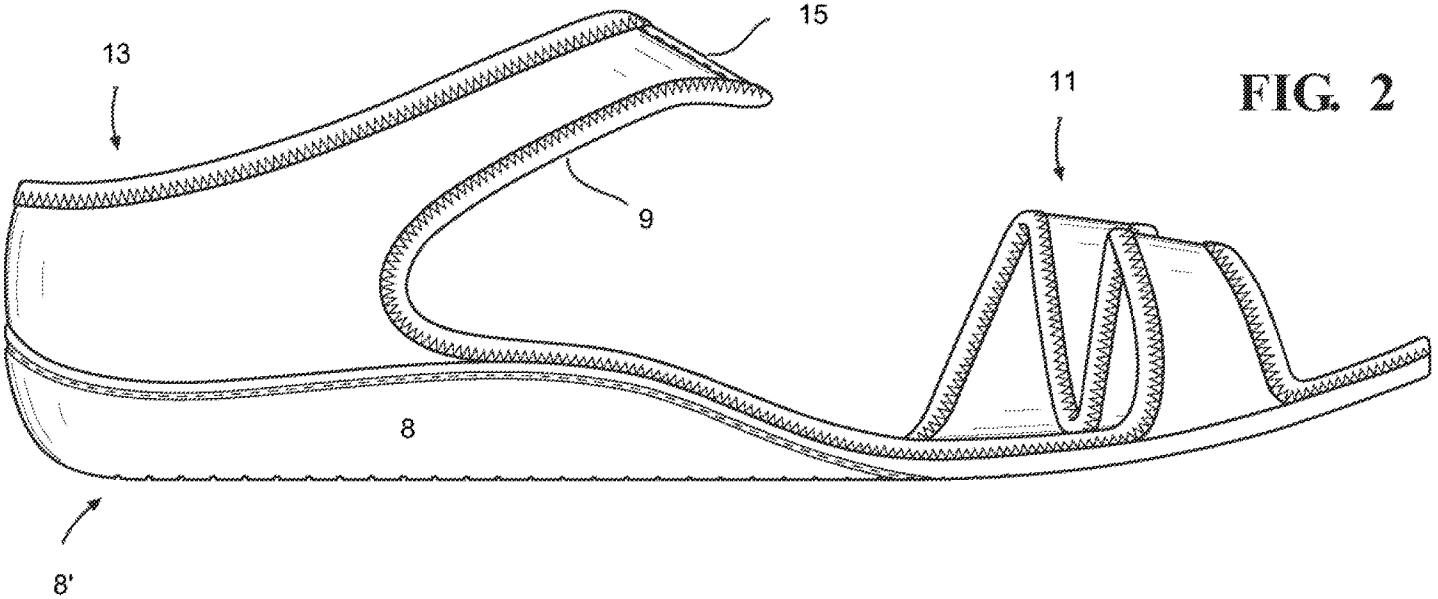
FIG. 2 is a right side view of an article of footwear according to one embodiment of the present invention.
Figure 3:
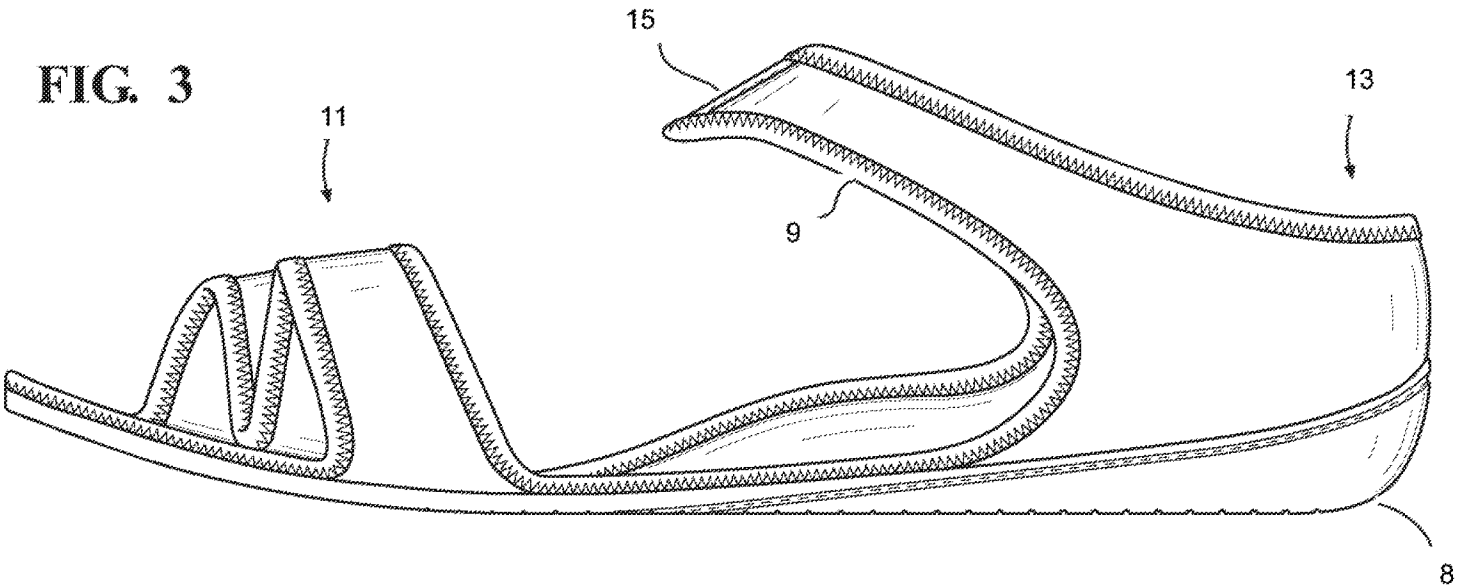
FIG. 3 is a left side view of the article of footwear of FIG. 2.

FIG. 2 is a right side view of an article of footwear according to one embodiment of the present invention. FIG. 3 is a left side view of the article of footwear of FIG. 2.

The article of footwear in FIGS. 2-5 includes an upper which can be fabricate from a blank or pattern of material as discussed above, and a sole made from a suitable material such as ethyl vinyl acetate. The upper and sole can be attached together by stitching and/or gluing and/or bonding in a conventional manner.

As shown in FIG. 2, the sole provides a bottom heel 8 having a height that extends along the sole into the midsole and then the height decreases at the outsole, with the forefoot area of the sole being inclined. In the left side view of FIG. 3 the decrease in height of the sole from the heel area to the toe area decreases more gradually and uniformly since the instep is only along the right side in FIG. 2. In further embodiments, the sole could be relatively flat with a uniform thickness or a thickness that is substantially uniform across the width at any given portion. The rear or ankle strap 9 is depicted as extending upward and forward is a manner that allows the rear or ankle strap 9 to wrap around a wearer's ankle and pull the heel towards the wearer's anterior ankle so as to keep the rear of the footwear from falling off the wearer. The forward protruding center portion 15 of the rear or ankle strap 9 is shown as being inclined downward in the forward direction so as to lay against the top surface of a wearer's foot. In FIGS. 2 and 3 the front or toe strap 11 is depicted as angling slightly rearward as one can imagine to conform to the general shape of a wearer's foot near the wearer's toes.

FIG. 4 is a rear view of the article of footwear of FIG. 2. FIG. 4 depicts the area 12 where the free rear ends 4' of the of the heel-strap flaps 3 are attached together by stitching/sewing and/or gluing and/or bonding to form the enclosed heel portion 13. Also shown in FIG. 4 is the bottom surface of the rear or ankle strap 9, including the area 14 at which the free front ends 6' of the heel-strap flaps 3 are attached together by stitching/sewing and/or gluing and/or bonding to form the rear or ankle strap 9. Further, the bottom portion of the forward protruding center portion 15 of the rear or ankle strap 9 is shown in FIG. 4 with the area at which the free front ends 6' of the heel-strap flaps 3 are attached together extending through the forward protruding center portion 15 of the rear or ankle strap 9. If desired a loop or tag of material such as a fabric material can be provided near the top of the heel at the rear to make it easier to pull the back of the footwear onto a wearer's foot.

FIG. 5 is a top view of the article of footwear of FIG. 2. FIG. 5 shows how the front or toe strap 11 extends at an angle across the toe area of the article of footwear according to one embodiment of the present invention. As noted above the front or toe strap 11 can be configured to extend across the toe area at any desired angle and can have a varying width rather that the uniform width depicted in FIG. 5. The front or toe strap 11 depicted in FIG. 5 is attached to the main bottom portion 1 to form a separate toe loop 16 for a wearer's big toe and another wider loop 17 for the remaining toes of a wearer.

The bottom of the sole to which the upper is attached can have any desired tread pattern to provide a non-slipping or gripping functionality.

Figure 6:
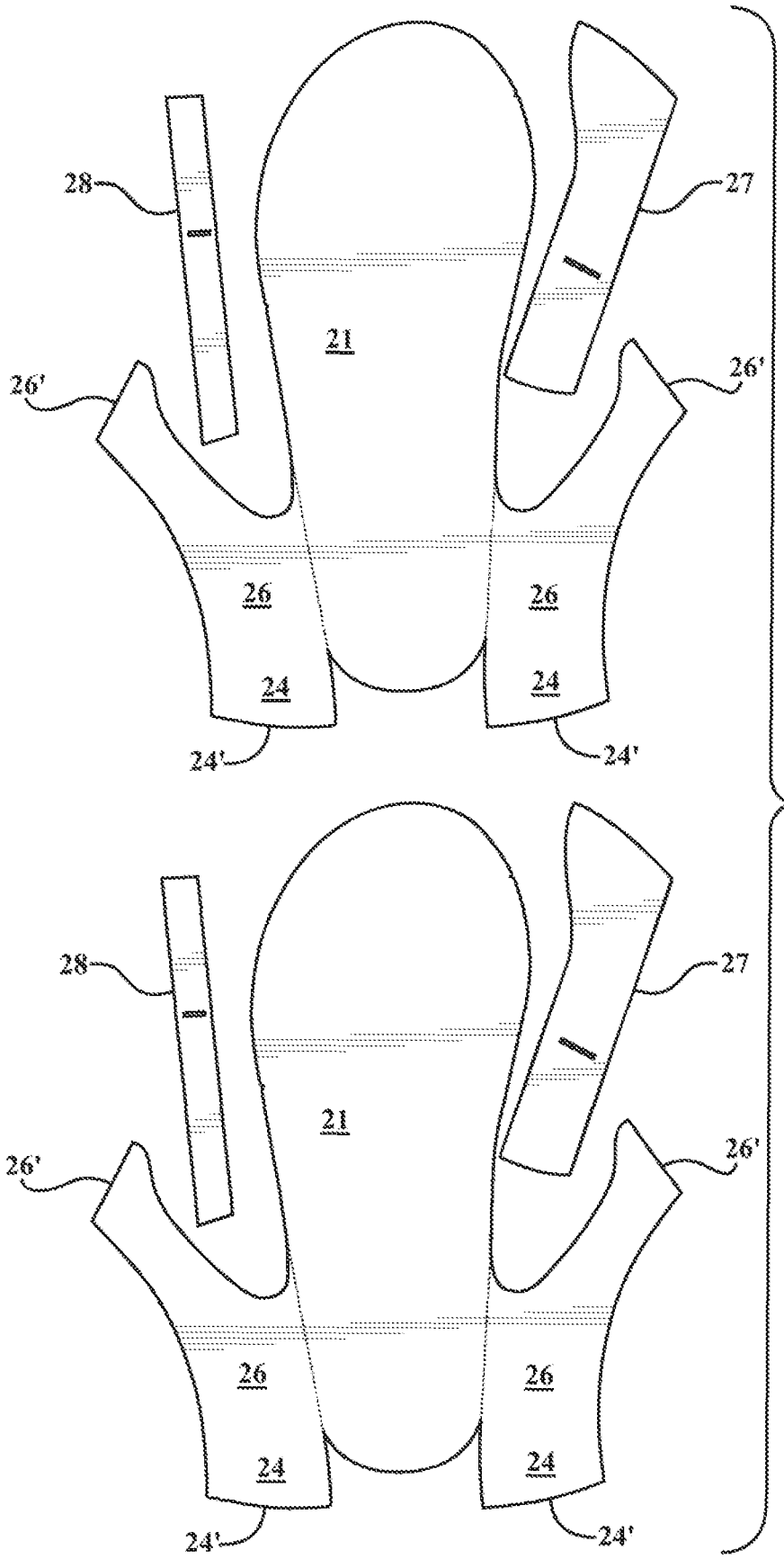
FIG. 6 is a plan view of an arrangement of a blank of material that forms a main body portion and separate toe strap according to further embodiments of the present invention.

FIG. 6 is a plan view of an arrangement of a blank or pattern of material that forms a main body portion and separate toe strap according to further embodiments of the present invention. To simplify the description of the embodiment of FIG. 6 it is noted that reference numbers identifying common elements shown in FIG. 1 have been increased by a factor of 20 for use in FIG. 6. For example, the main bottom portion identified by reference number 1 in FIG. 1 is represented by reference number 21 in FIG. 6.

FIG. 6 depicts one manner of arranging the design for the blank or pattern of material comprising a main bottom portion 21 and the toe strap 27 separately so as to minimize waste material that is left over when the blank or pattern of material comprising a main bottom portion 21 and toe strap 27 are cut out of stock material. Here it is noted that in all embodiments of the present invention the blank of material and separate toe strap used in some embodiments can be cut from stock material by laser cutting, mechanical cutting, punching or stamping, of any other suitable process.

The shape of the blank or pattern of material in the embodiment of the invention show in FIG. 6 is substantially the same as the blank or pattern of material shown in FIG. 1 except that the toe strap 27 is not attached to the main bottom portion 21. Otherwise the blank or pattern of material has a main bottom portion 21 and a pair of heel-strap flaps 26 that are substantially similar in shape to the main body portion 1 and heel-strap flaps 6 shown in FIG. 1. Further, in a similar manner described above in reference to the embodiment of FIG. 1 the free rear ends 24' of heel-strap flaps 26 are used to form an enclosed heel portion of a footwear and the free front ends 26' of the heel-strap flaps 26 are used to form a rear or ankle strap of the footwear.

In FIG. 6 the main body portion 21 and the toe strap 27 are depicted as being aligned with one another in longitudinal direction that extends along the front and rear portions of the main body portion 21. Also shown in FIG. 6 is an optional label strip 28 that can be attached (sewn, glued, stitched, etc.) onto the top of the toe strap 27 when the footwear is assembled.

It is to be understood that the arrangement of the main body portion 21, toe strap 22 and optional label strip 28 is not limited to the arrangement shown in FIG. 6. For example, two or more main body portions 21 could be arranged side-by-side in the transverse direction with the toe strap 27 and optional label strip 28 aligned longitudinally between adjacent ones of the main body portion 21. The arrangement of the main body portion 21, toe strap 22 an optional label strip 28 can be varied as desired so that waste material is minimized or used for some other purpose when cutting the main body portion 21, toe strap 27 and optional label strip from stock material.

Although the present invention has been described with reference to particular means, materials and embodiments, from the foregoing description, one skilled in the art can easily ascertain the essential characteristics of the present invention and various changes and modifications can be made to adapt the various uses and characteristics without departing from the spirit and scope of the present invention as described above and set forth in the attached claims.

The invention claimed is:

1. A pattern for cutting flexible sheet material for forming an article of footwear upper, said pattern comprising:

a main bottom portion having a front toe area, a rear heel area and opposed sides, said main bottom portion being in the general shape of a foot sole;

a single front toe strap portion having an elongated shape; and and a single pair of heel-strap flaps extending outward from opposite sides of the main bottom portion near the rear heel area, both members of the single pair of heel-strap flaps comprise rear portions that are substantially parallel to one another and to a centerline of the main body portion and have free rear ends and rear inner edges between ends of the heel-strap flaps and an end of the main bottom portion, both members of the single pair of heel-strap flaps further having outward curving forward portions having free front ends, wherein joining the free rear ends of the single pair heel-strap flaps together and joining the rear inner edges of the single pair of heel-strap flaps to the main bottom portion produces an enclosed, imperforated heel portion and joining the free front ends of the single pair of heel-strap flaps together produces an ankle strap having a central axis that extends outwardly from a bottom center of the enclosed heel portion, wherein the main body portion and the single pair of heel-strap flaps comprise a single, continuous, imperforated piece of flexible sheet material and portions of the heel strap flaps which are used to form sides of the enclosed heel portion are continuous with the main bottom portion and imperforated.

2. A pattern for cutting flexible material for forming an article of footwear upper according to claim 1, wherein the single front strap portion extends outward from one of the opposite sides of the main body portion near the front toe area and includes a free end, and main body portion, the single front strap portion and the single pair of heel-strap flaps comprise a single pattern piece.

3. A blank of flexible material cut from a flexible fabric according to the pattern of claim 2.

4. An article of footwear upper made from the blank of flexible material of claim 3.

5. An article of footwear comprising the article of footwear upper of claim 4 attached to a sole.

6. A pattern for cutting flexible material for forming an article of footwear upper according to claim 2, wherein the single front strap portion extends outward from the main bottom portion at an obtuse angle with respect to a center line of the main bottom portion.

7. A blank of flexible material cut from a flexible fabric according to the pattern of claim 1.

8. An article of footwear upper made from the blank of flexible material of claim 7.

9. An article of footwear comprising the article of footwear upper of claim 8 attached to a sole.

* * * * *